US005454498A

United States Patent [19]

Dunn et al.

[11] Patent Number: 5,454,498

[45] Date of Patent: Oct. 3, 1995

[54] BABY CARRIER

[76] Inventors: Michelle L. Dunn, 22232 24th Ave. South - Q-116, Des Moines, Wash. 98198; Katherine A. Dunn, 3814 Poker Flats Rd., Great Falls, Mont. 59401

[21] Appl. No.: 110,717

[22] Filed: Aug. 23, 1993

[51] Int. Cl.[6] ..... A45F 3/04

[52] U.S. Cl. ..... 224/160

[58] Field of Search ..... 224/160, 159, 224/158

[56] References Cited

U.S. PATENT DOCUMENTS

D. 307,821 5/1990 Fallon ..... 224/159 X 416,970 12/1889 Taylor ..... 224/159

4,402,440 9/1983 Purtzer et al. ..... 224/160

5,289,959 3/1994 Beeley et al. ..... 224/160

*Primary Examiner*—Renee S. Luebke

[57] ABSTRACT

A baby carrier for twin infants which includes a shoulder harness, a pair of soft fabric infant supporting pouches dependent from the front of the harness, a pair of shoulder straps to hold the pouches against the body of the wearer, a zipper for removably securing the pouches one to the other, and a narrow strap to removably retain infants within said pouches.

1 Claim, 4 Drawing Sheets

BABY CARRIER

BACKGROUND OF THE INVENTION

1. Field of the Invention

The present invention relates to baby carriers and more particularly pertains to such carriers which are specially designed to carry twin infants.

2. Description of the Prior Art

The use of shoulder supported baby carriers is known in the prior art. More specifically, such carriers heretofore devised and utilized for the purpose of carrying infants are known to consist basically of familiar, expected and obvious structural configurations, notwithstanding the myriad of designs encompassed by the crowded prior art which have been developed for the fulfillment of countless objectives and requirements. Usually such carriers have taken the form of slings or back pack type devices adapted to carry only one child. Typical of these are U.S. Pat. Nos. 4,484,700 and 4,790,459. One multiple baby carrier has been noted, i.e. U.S. Pat. No. 275,812 especially adjusted by hospital personnel to move babies from one location to another but not for use while the wearer is otherwise occupied.

In this respect, the baby carrier according to the present invention substantially departs from the conventional concepts and designs of the prior art, and in so doing provides a carrier primarily developed for the purpose of transporting twin infants safely while the wearer engages in shopping or other pursuits.

Therefore, it can be appreciated that there exists a continuing need for new and improved baby carrier which can be utilized for twins. In this regard, the present invention substantially fulfills this need.

SUMMARY OF THE INVENTION

In view of the foregoing disadvantages inherent in the known types of baby carriers now present in the prior art, the present invention provides an improved baby carrier construction wherein the same can be utilized to carry twins safely and securely. As such, the general purpose of the present invention, which will be described subsequently in greater detail, is to provide a new and improved baby carrier which has all the advantages of the prior art carriers and none of the disadvantages.

To attain this, the present invention relates to a baby carrier for twin infants which comprises a shoulder harness; a pair of soft fabric infant supporting pouches dependent from the front of said harness; means to hold said pouches against the body of the wearer; means to removably affix said pouches one to the other; and means to removably retain infants within said pouches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baby carrier which has all the advantages of the prior art carriers and none of the disadvantages.

It is another object of the present invention to provide a new and improved baby carrier which may be easily and efficiently manufactured and marketed.

It is a further object of the present invention to provide a new and improved baby carrier which is of a durable and reliable construction.

An even further object of the present invention is to provide a new and improved baby carrier which is susceptible of a low cost of manufacture with regard to both materials and labor, and which accordingly is then susceptible of low prices of sale to the consuming public, thereby making such carriers economically available to the buying public.

Still yet another object of the present invention is to provide a new and improved baby carrier which provides in the apparatuses of the prior art some of the advantages thereof, while simultaneously overcoming some of the disadvantages normally associated therewith.

Still another object of the present invention is to provide a new and improved baby carrier for safely carrying twin infants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
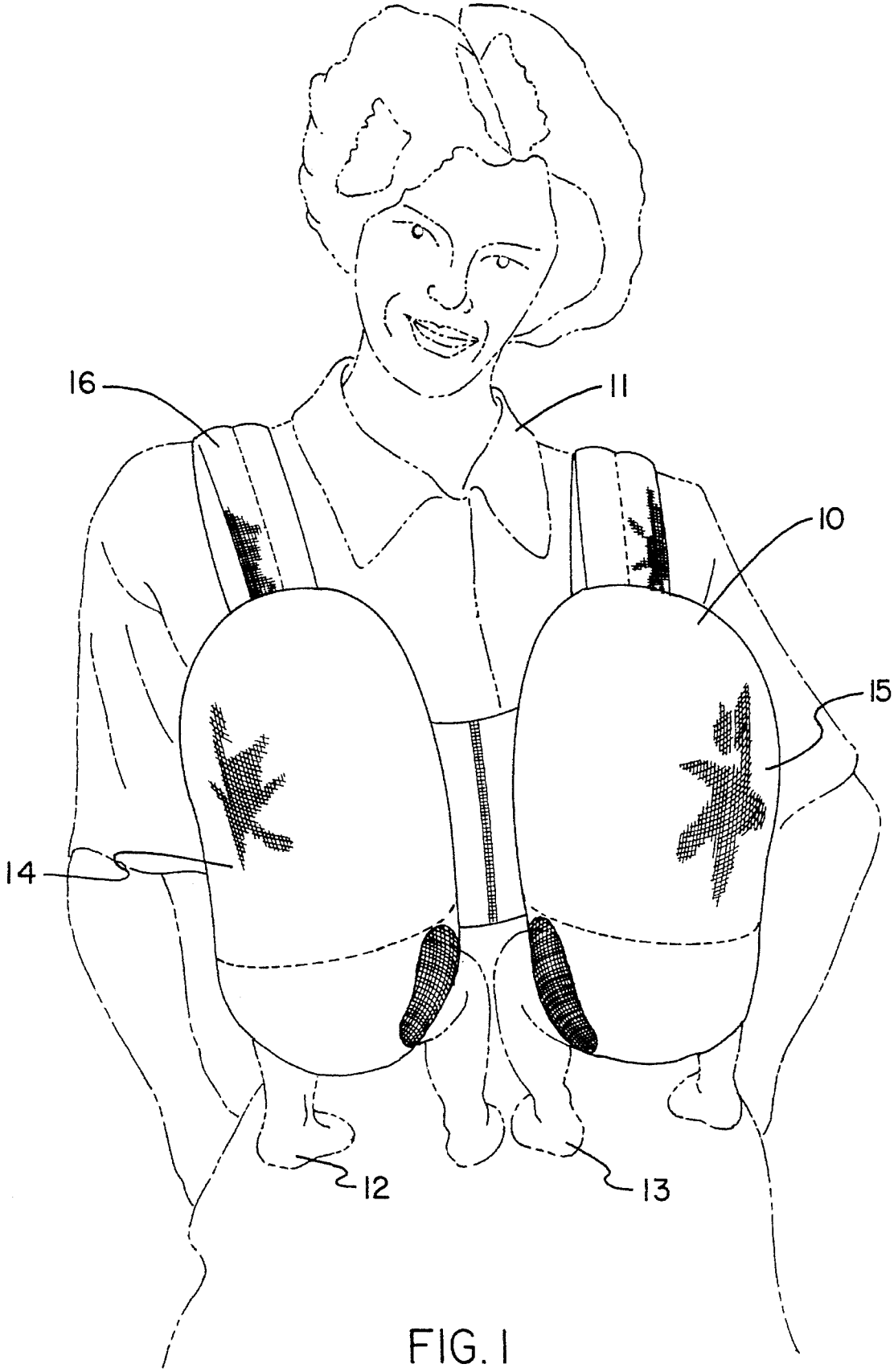
FIG. 1 is a perspective view showing the device of the present invention in carrying position on a wearer (shown in broken lines).

With reference now to the drawings, and in particular to FIG. 1 thereof, a new and improved baby carrier embodying the principles and concepts of the present invention and generally designated by the reference numeral 10 will be described.

More specifically, it will be noted that the carrier 10 of the present invention is designed specifically to carry two infants at the same time. Shown in relationship to the wearer 11, the device carries the two infants 12 and 13 facing the front of the wearer 11 so that their needs are both more apparent and can be more readily attended to than would be the case if they were positioned otherwise. The infants 12 and 13 are contained within two flexible fabric pouches 14 and 15 suspended from the shoulders of the wearer 11 by a harness system 16 (more clearly shown in FIGS. 2 and 3 below).

Figure 2:
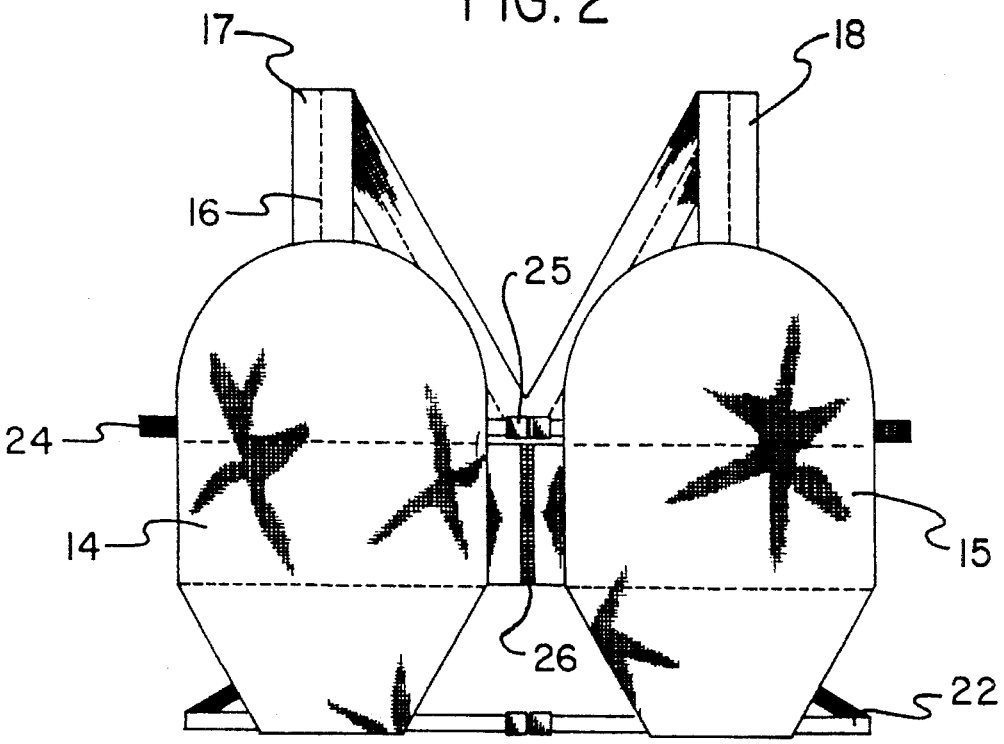
FIG. 2 is a front plan view (referring to the direction in which the wearer is facing) of the device of the present invention.
Figure 3:
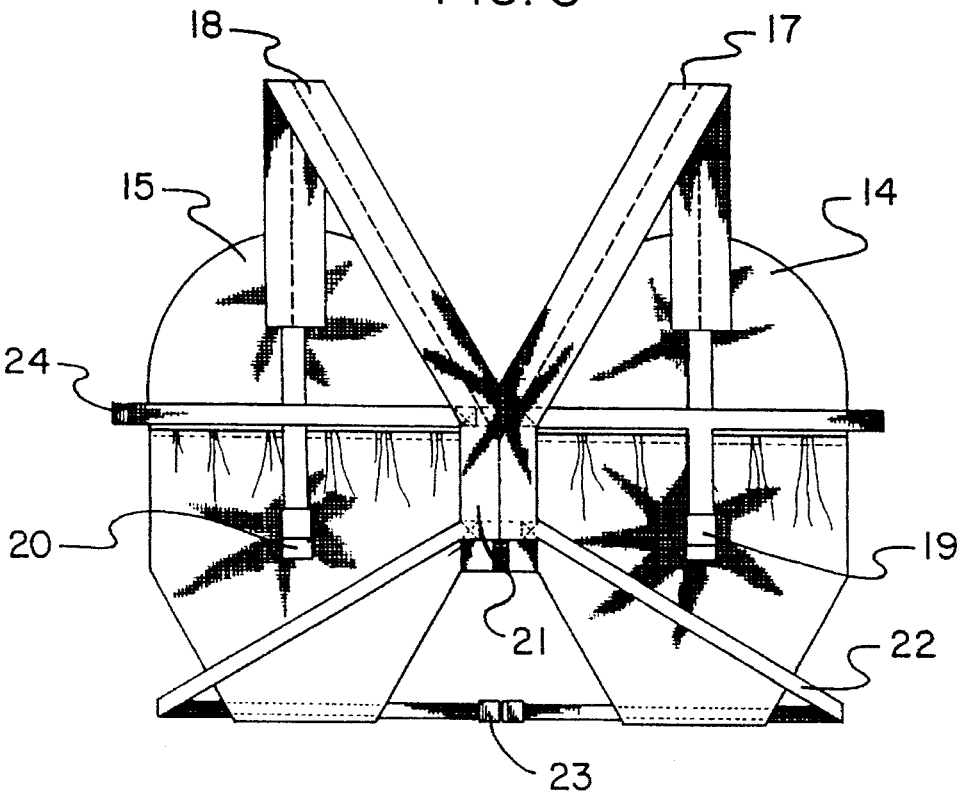
FIG. 3 is a back plan view of the device of FIG. 2.

In FIG. 2 and 3, the harness system 16 is seen to consist of a pair of shoulder straps 17 and 18 adapted to pass over the shoulders of the wearer as shown in FIG. 1 and to be secured by clip type buckles 19 and 20 to the two flexible fabric pouches 14 and 15. The shoulder straps 17 and 18 are joined at the ends behind the wearer's back as shown at 21 in FIG. 3. A narrow webbing strap 22 extends from juncture points 21 down and around the base of pouches 14 and 15 to which it is fastened as shown in FIG. 5 and is then secured in front of the wearer by another clip type buckle 23. A second narrow webbing strap 24 runs horizontally around the body of the wearer and through loops (shown in FIGS. 4 and 5) to secure strap 24 to the pouches 14 and 15. Again, the ends of strap 24 are secured to each other by a clip type buckle 25 in front of the wearer. Normally, the pouches 14 and 15 are also secured one to the other by releasable fastening means shown in FIG. 2 as a zipper 26 to form the whole into a unitary structure as is more fully discussed below.

The zipper 26 as illustrated in FIG. 2 for example, employs respective first and second fastener portions secured to respective pouches 14 and 15 for selective securement of the first and second fastener portions.

Figure 4:
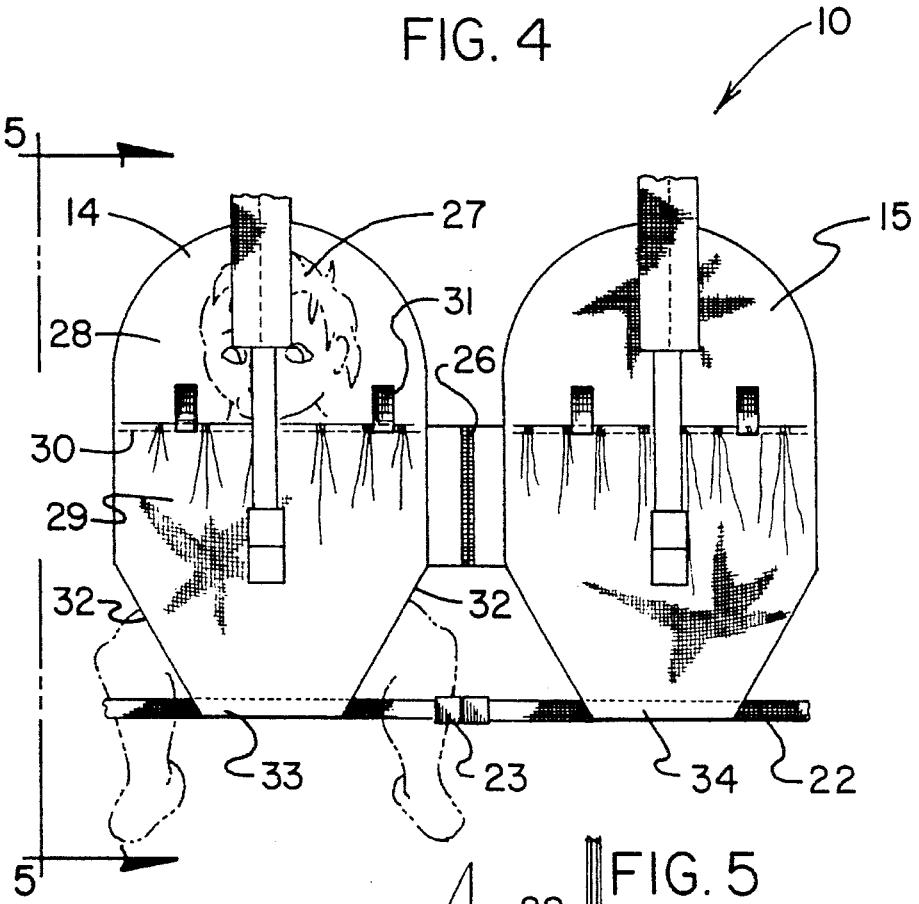
FIG. 4 is a partial view of the back of the device showing an infant (drawn in broken lines) in one of the pockets of such device.
Figure 5:
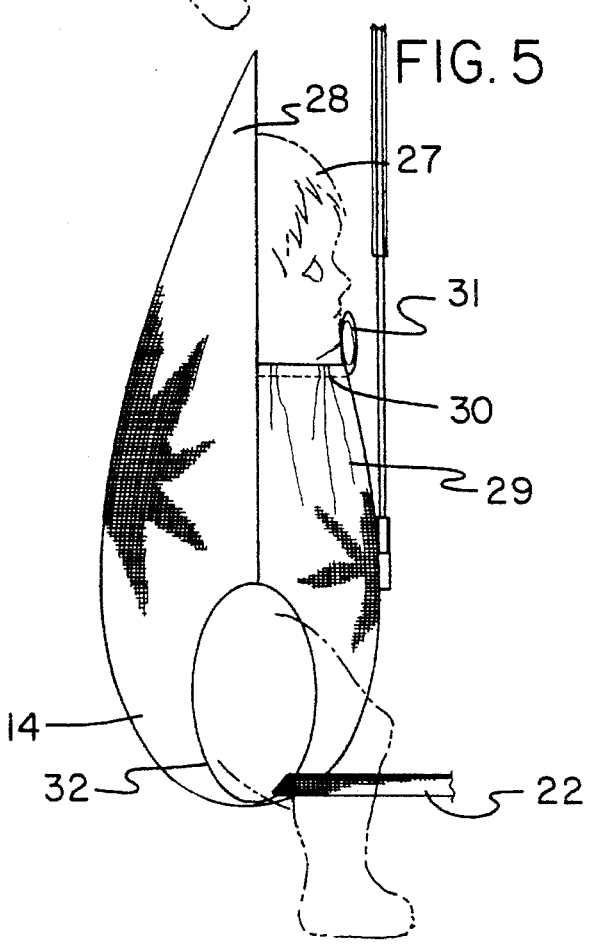
FIG. 5 is a side view on line 5—5 of FIG. 4.

Referring now to FIGS. 4 and 5 the device 10 is shown to permit concentration on flexible pouches 14 and 15 as they appear in use. The infant (shown at 27 in broken lines) fits down into pouch 14 which has a back portion 28 and a front portion 29 extending loosely upwards but terminating at a line substantially below the top of the back portion 28 to permit the head of the infant 27 to extend thereabove. An elastic band 30 is preferably sewn into the top hem of the front portion 29 to assist in keeping the infant 27 in place. Also fastened to the top hem of front portion 29 are a plurality of belt loops 31 adapted to receive therein the narrow strap 24 shown in FIG. 3 which also serves to retain the infant 27 in position within pouch 14. Front portion 29 has two cut outs 32 at the base thereof to permit the legs of the infant 27 to extend out of pouch 14. Strap 22 which extends around the body of the wearer passes through securing tunnels 33 and 34 in the bottoms of pouches 14 and 15 and is secured in the front of the wearer by buckle 23.

Normally secured together by zipper 26 as shown, pouches 14 and 15 may be separated utilizing said zipper 26 to permit removing or attending to one child only without disturbing the other.

Figure 6:
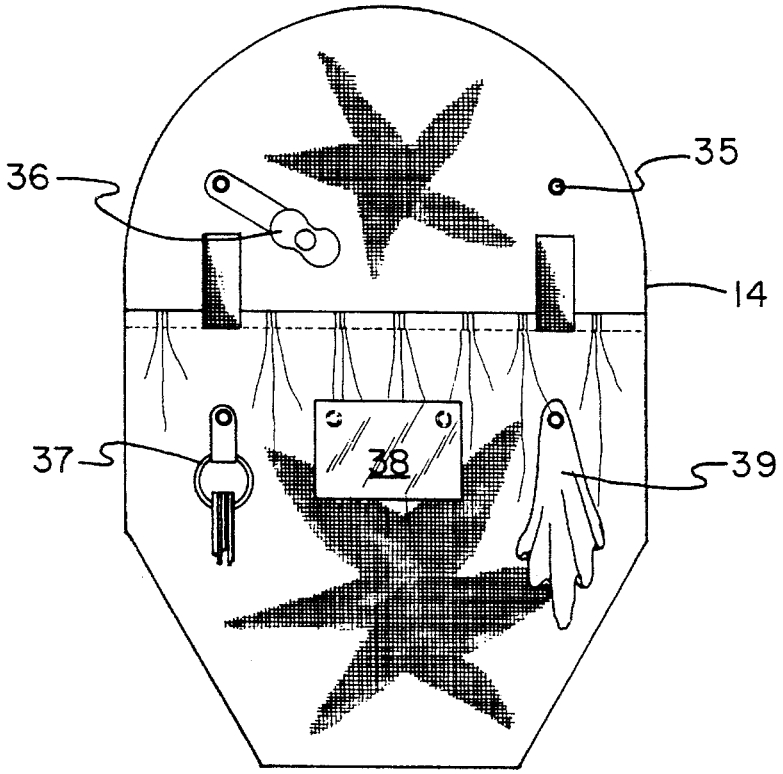
FIG. 6 and 7 are partial back views of one of the pouches shown in the preceding Figures, illustrating additional features which may be added thereto.
Figure 7:
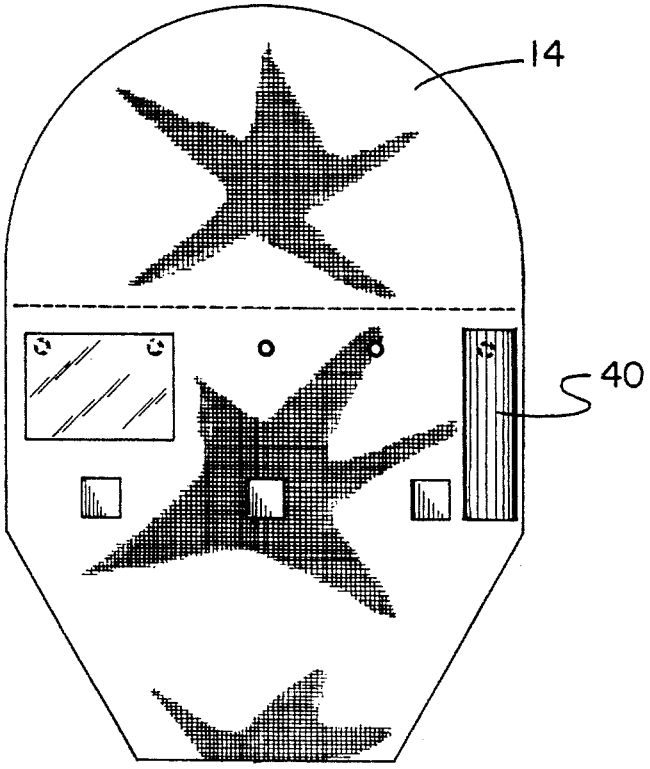

Additional accessories may be positioned on pouches 14 and 15 as shown in FIGS. 6 and 7. Utilizing button snaps 35, various items such as a pacifier 36, key ring 37, money carrier 38, burp cloth 39, etc. can be added. A bottle holder 40 can also be affixed to the back of the pouch 14. Hook and loop fasteners, sewn cloth loops or other types of fastening means can be substituted if desired.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A baby carrier for twin infants, said carrier comprising:

a shoulder harness suspendable from shoulders of an individual;

a pair of fabric infant supporting pouches detachably secured together and removably suspended from a front of said shoulder harness;

a first strap means extending through each of said pouches to secure infants within said pouches; said first strap means being spaced from said harness, a second strap means directed through each of said pouches to secure said pouches to said individual;

and, wherein fastening means securing said pouches to said harness and securing each end of each of said strap means to one another are positioned in a front of said individual.

* * * * *